United States Patent [19]

Greer et al.

[11] 3,997,058

[45] Dec. 14, 1976

[54] CAPSULE INSPECTION MACHINE

[75] Inventors: Henry W. Greer, Philadelphia, Pa.; George E. Martell, Runnemede, N.J.

[73] Assignee: SmithKline Corporation, Philadelphia, Pa.

[22] Filed: Jan. 29, 1976

[21] Appl. No.: 653,299

[52] U.S. Cl. ..... 209/75; 209/74 R; 209/87; 209/104

[51] Int. Cl.[2] ..... B07C 5/06; B07C 5/36

[58] Field of Search ..... 209/73, 74 R, 75, 82, 209/83, 87, 97, 104, 105

[56] References Cited

UNITED STATES PATENTS

| | | | |
|---|---|---|---|
| 1,677,838 | 7/1928 | Molin | 209/104 |
| 2,771,191 | 11/1956 | Kath | 209/75 |
| 3,064,808 | 11/1962 | Fricke | 209/83 X |
| 3,709,329 | 1/1973 | Mlodzinski | 209/75 |

*Primary Examiner*—Stanley H. Tollberg
*Assistant Examiner*—Joseph J. Rolla
*Attorney, Agent, or Firm*—Smith, Harding, Earley & Follmer

[57] ABSTRACT

A capsule inspection machine has a horizontal ring with vertical openings having a minimum diameter equal to a predetermined maximum capsule cap diameter for the reception of individual capsules and a motor to rotate this ring. A capsule feeding device feeds capsules to a sorting wheel having plates perpendicular to the axis of the wheel and spaced apart a distance greater than the diameter of the capsule body and slightly less than the diameter of a capsule cap to pass through uncapped bodies and carry capped bodies with caps having the desired minimum diameter. A second motor rotates the wheel on a horizontal axis to advance capped bodies and discharge them onto the ring and into the ring openings. A fixed horizontal plate is mounted below a portion of the ring to support the capsules received in the ring openings, the plate being a distance below the ring slightly greater than the length of a capsule cap and less than the length of a complete capsule so that the complete capsules with caps having the desired maximum diameter will be carried along the plate by the ring while separate capsule caps will drop onto the plate and clear of the ring. A vacuum system removes all separate caps from the plate. The completed capsules having caps with a diameter equal to or less than the predetermined maximum capsule diameter are discharged by gravity from the ring openings when they are carried beyond the plate. A second vacuum system removes the capsules having caps exceeding the desired maximum diameter and remaining in the ring openings and capsules remaining on the top of the ring.

5 Claims, 8 Drawing Figures

FIG. 4.
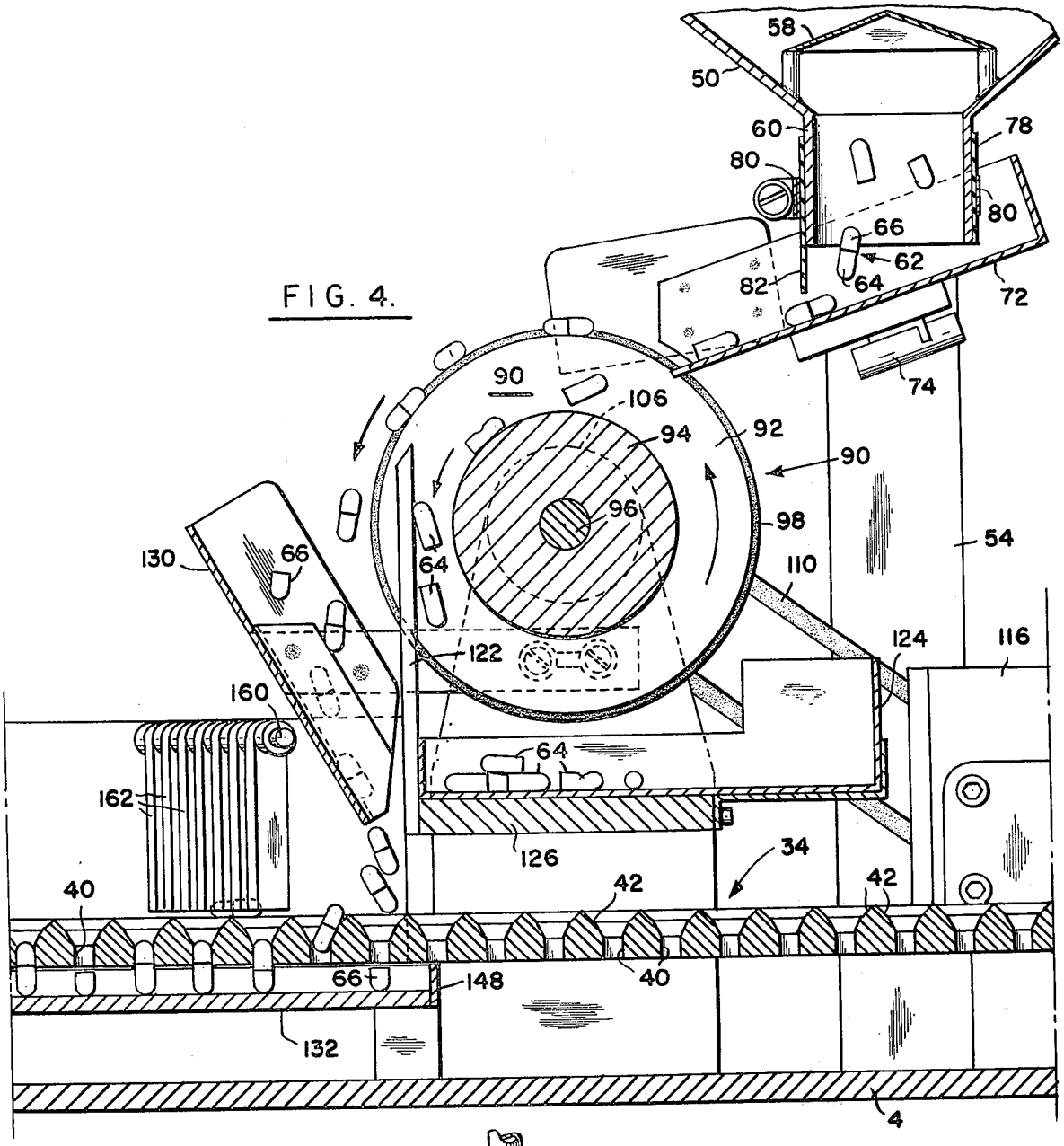
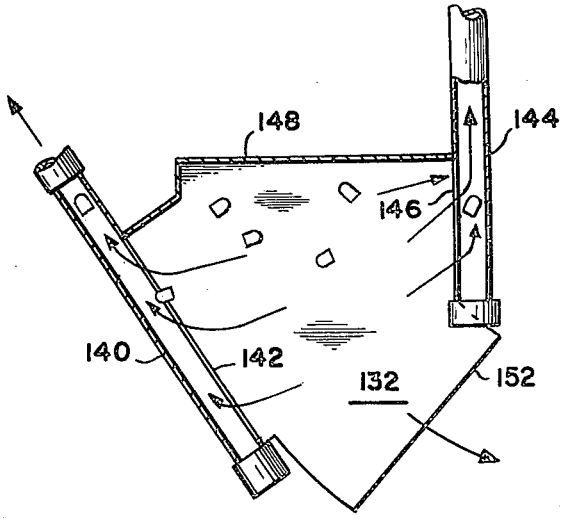
FIG. 5.

CAPSULE INSPECTION MACHINE

BACKGROUND OF THE INVENTION

Much time and material is lost in a capsule filling operation due to inadequate inspection of the capsules. The normal frequent absence of a mating cap or body results in inefficiency. Further, improperly sized capsules result in the clogging of the capsule filling apparatus and downtime to remove such clogging. Conventionally capsule inspection to insure the feeding of only completed capsules with both a cap and a body and capsules of the proper size is carried out manually using magnifying equipment.

SUMMARY OF THE INVENTION

A capsule inspection machine has a horizontal ring with vertical openings having a minimum diameter equal to a predetermined maximum capsule cap diameter for the reception of individual capsules and means to rotate this ring. Capsule feeding means feeds capsules to a sorting wheel having plates perpendicular to the axis of the wheel and spaced apart a distance greater than the diameter of the capsule body and slightly less than the diameter of a capsule cap to pass through uncapped bodies and carry capped bodies with caps having the desired minimum diameter. Means rotates the wheel on a horizontal axis to advance capped bodies and discharge them onto the ring and into the ring openings. A fixed horizontal plate is mounted below a portion of the ring to support the capsules received in the ring openings, the plate being a distance below the ring slightly greater than the length of a capsule cap and less than the length of a complete capsule so that the complete capsules with caps having the desired maximum diameter will be carried along the plate by the ring while separate capsule caps will drop onto the plate and clear of the ring. Means, advantageously vacuum means, remove all separate caps from the plate. The completed capsules having caps with a diameter equal to or less than the predetermined maximum capsule diameter are discharged by gravity from the ring openings when they are carried beyond the plate. Means, advantageously vacuum means, remove the capsules having caps exceeding the desired maximum diameter and remaining in the ring openings and capsules remaining on the top of the ring.

BRIEF DESCRIPTION OF THE DRAWINGS

FIG. 4 is a section taken on the plane indicated by the line 4—4 in FIG. 2 and is partially broken away;

FIG. 5 is a view partially broken away showing the fixed plate mounted below the rotating ring of the machine of FIG. 1;

DETAILED DESCRIPTION

Figure 1:
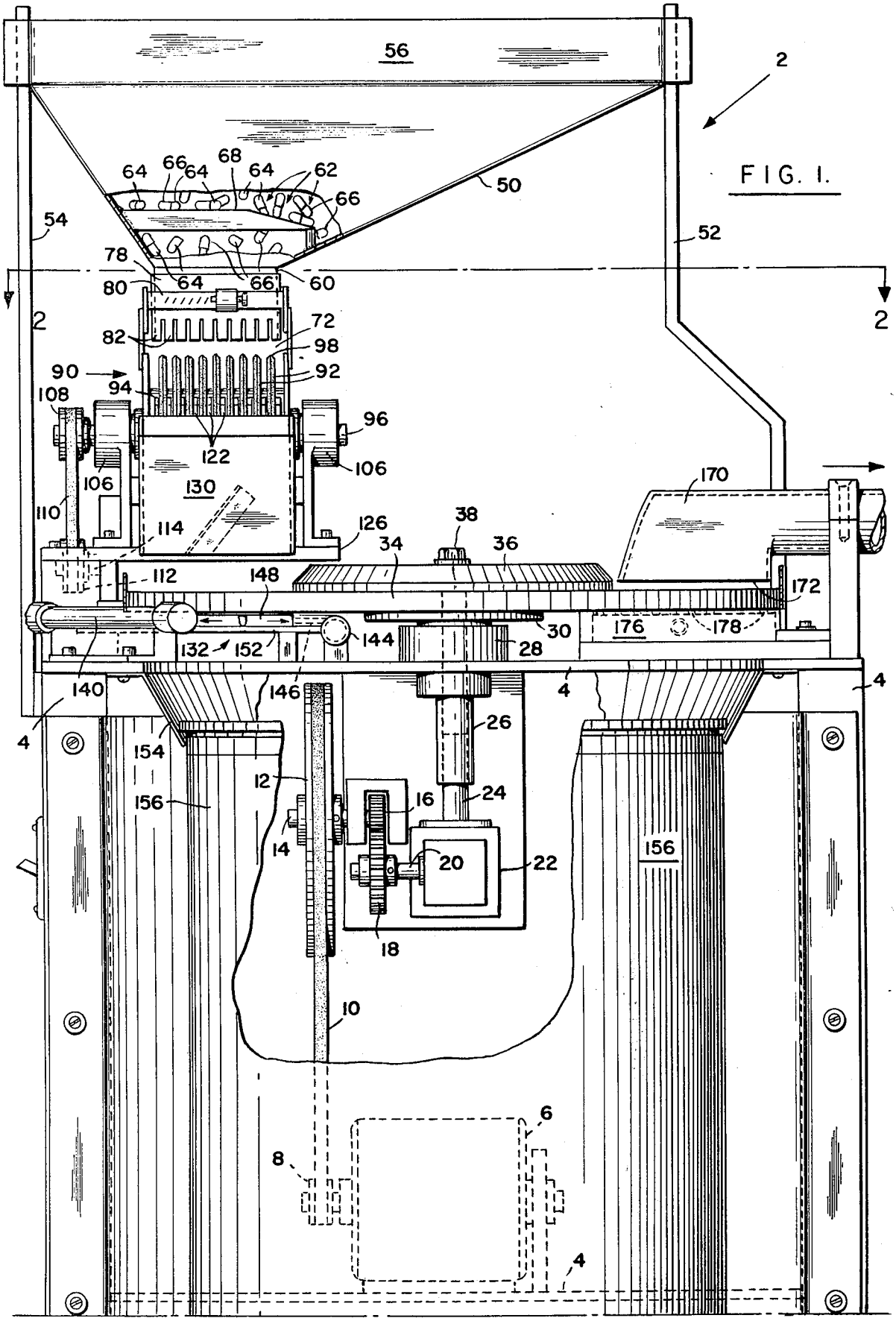
FIG. 1 is a front elevation of a capsule inspection machine in accordance with the invention.

As shown in FIG. 1, a capsule inspection machine 2 has a supporting frame 4. A motor 6 is mounted on frame 4 and drives a pulley 8 which drives a belt 10 mounted on pulley 12 which is secured to a shaft 14. Shaft 14 drives gear 16 which drives gear 18 which in turn is connected to shaft 20 of reduction gear box 22. Gear box 22 has an output shaft 24 which is connected to a shaft 26 mounted for rotation on frame 4 in bearing 28. Shaft 26 has a disc 30 fixedly secured thereto which abuts against a ring 34 which is clamped to disc 30 for rotation therewith by a disc 36 and a machine screw 38 screwed into the end of shaft 26. Ring 34 has capsule receiving openings 40 (FIG. 2) which as best seen in FIG. 4 have substantially funnel-shaped entrance portions 42 to facilitate the entry of a capsule.

Figure 6:
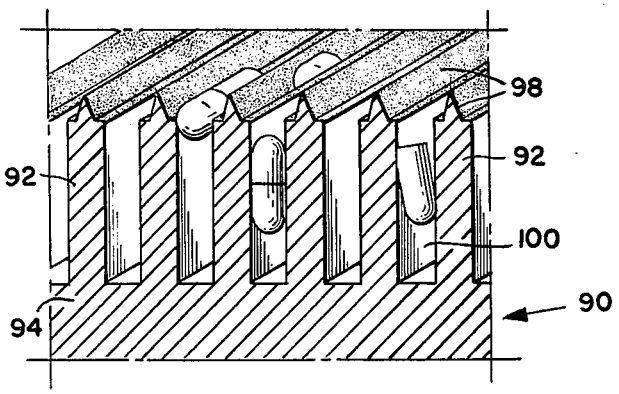
FIG. 6 is a partially broken away section of a perspective view of the sorting wheel of the machine of FIG. 1.

Referring back to FIG. 1, a capsule hopper 50 is secured to frame 4 by standards 52 and 54 and strap 56. Hopper 50 has a deflector 58 spaced above its discharge neck 60. Hopper 50 contains completed capsules 62 each having a body 64 and a cap 66. It also contains separate bodies and caps. The contents of hopper 50 are discharged through neck 60 onto a chute 72 which is vibrated by a conventional vibrator shown at 74. A rubber tube 78 is telescoped over neck 60 and held thereto by an adjustable strap shown at 80 (see FIG. 4). As best seen in FIG. 1, rubber fingers 82 depend from tube 78 below neck 60 to a position above chute 72 to regulate the flow of capsules 62 down the chute. Chute 72 delivers capsules and separate capsule bodies and caps to sorting wheel 90 which has discs 92 each extending outwardly from a hub 94 in a plane perpendicular to the axis of a shaft 96 to which hub 94 is fixedly secured. Each disc 92 has an outer V-shaped apex portion 98 (FIG. 6) to facilitate the orientation of capsules and parts thereof with their lengths lying between adjacent portions 98. The discs 92 are spaced apart a distance greater than the diameter of the capsule body and less than a predetermined maximum cap diameter.

Figure 2:
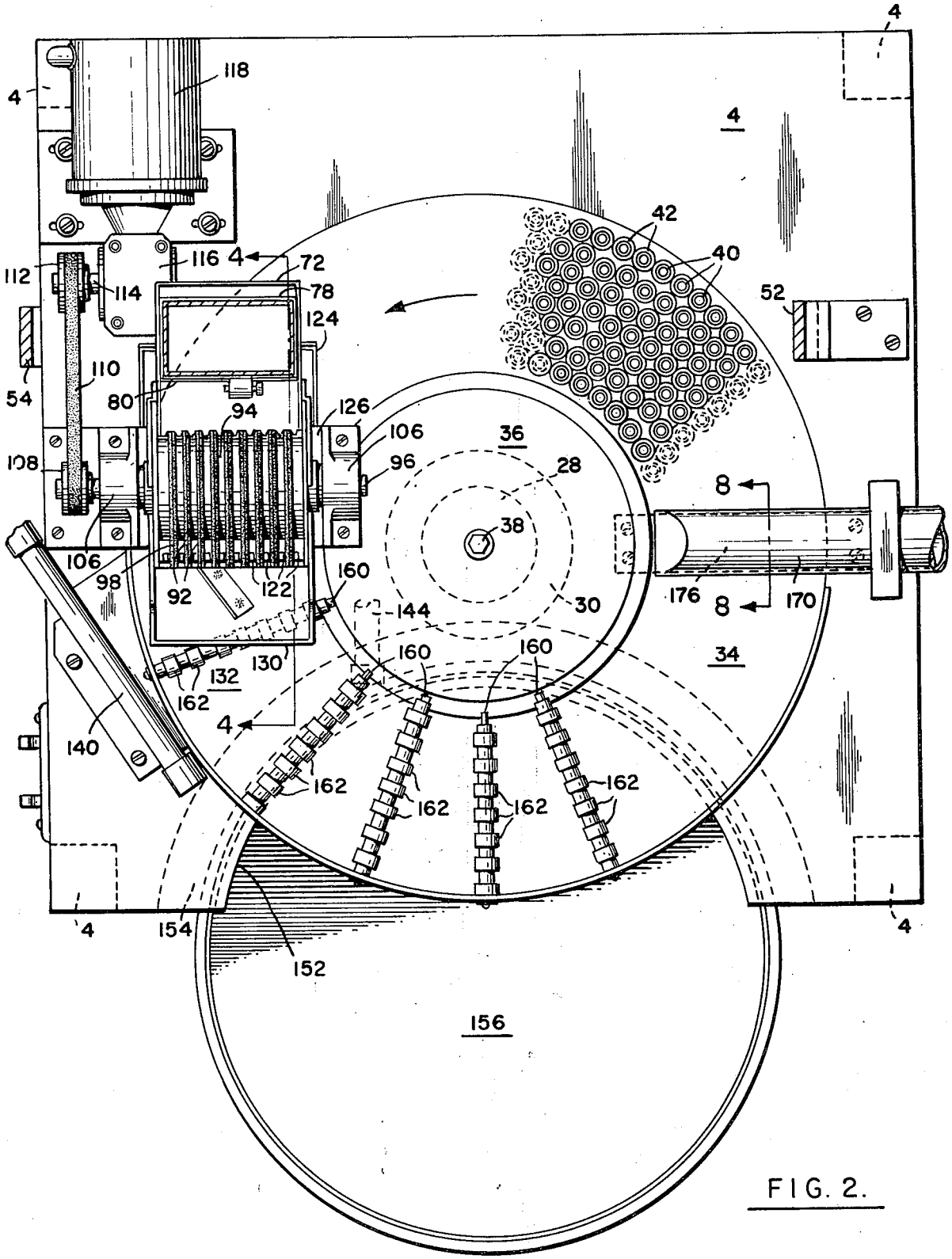
FIG. 2 is a section taken on the plane indicated by the line 2—2 in FIG. 1.
Figure 3:
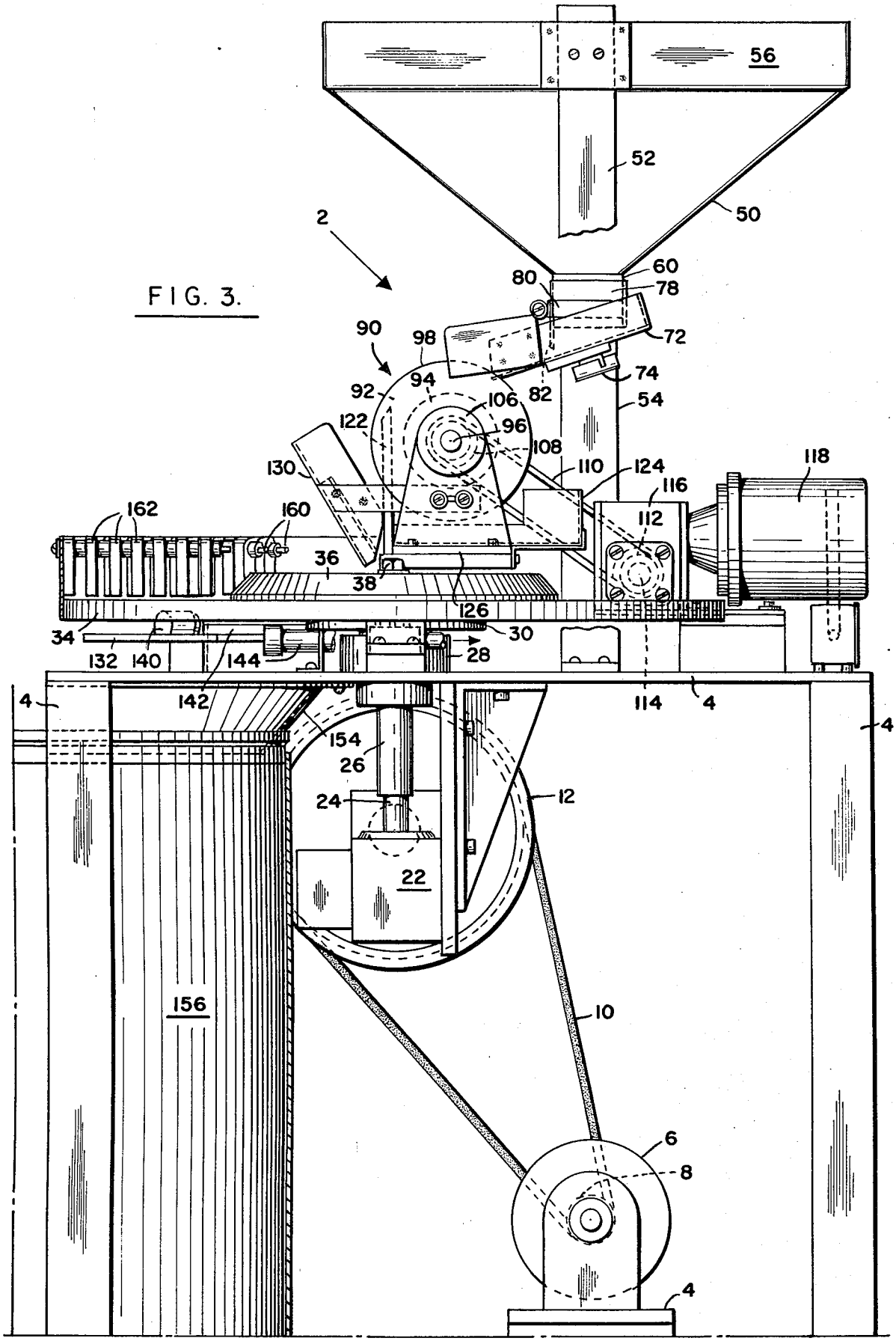
FIG. 3 is a right side elevation of the machine of FIG. 1.

As best seen in FIG. 2 shaft 96 is mounted for rotation in bearings 106, 106 and is fixedly secured to a pulley 108 which is driven by a belt 110 which, in turn, is driven by a pulley 112 secured to a shaft 114 driven by reduction gear box 116 which, in turn, is driven by a motor 118. Sorting wheel 90 is driven counterclockwise as viewed in FIG. 4 and ring 34 is driven counterclockwise as viewed in FIG. 2.

Substantially vertically deflection bars 122 (FIG. 4) are fixedly mounted between plates 92 to deflect downwardly any capsules or capsule parts which enter into openings 100 below the apex portions 98 of plates 92. The deflected material falls downwardly into a waste tray 124 removably mounted on a support 126 mounted on frame 4.

The complete capsules and capsule caps remaining generally between the apex portions 98 and not dropping between discs 92 are carried around by wheel 90 and discharged by centrifugal force against a chute 130 which discharges downwardly onto ring 34. The discharged completed capsules and capsule parts are adapted to be received in ring openings 40 which have a diameter equal to the maximum desired cap diameter. A plate 132 is fixedly mounted on frame 4 to support complete capsules which freely pass through openings 40. The plate 132 is spaced below ring 34 a distance slightly greater than the length of a capsule cap but less than the length of a complete assembled capsule so as to permit capsule caps to drop clear of the ring while permitting the ring to advance completed capsules which are free to pass through openings 40. An exhaust manifold 140 (FIG. 5) has an opening 142 adjacent one side of plate 132 and an exhaust manifold 144 has an opening 146 adjacent the opposite side of plate 132. A barrier 148 connects manifolds 140 and 144 and lies between ring 34 and plate 132. Manifolds 140 and 144 are connected to a source of vacuum not shown. The plate 132 extends under a portion of ring 34 terminating at edge 152 beyond which capsules are free to drop into chute 154 (FIG. 1) and thence into a container 156.

Above ring 34 are mounted a plurality of rods 160 each carrying a series of fingers 162 which just clear the top surface of ring 34 and align capsules remaining on top of the ring to position them to fall into the ring openings 40.

Figure 8:
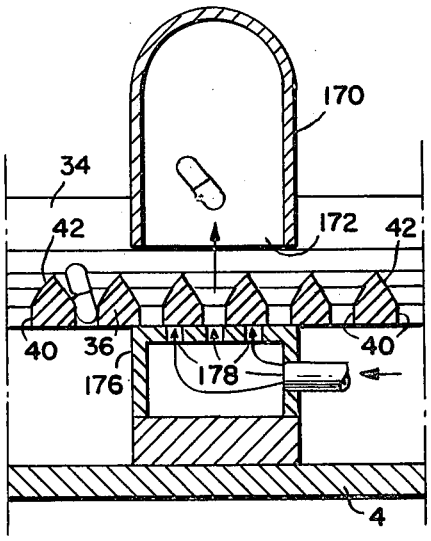
FIG. 8 is a view partially broken away taken on the plane indicated by the line 8—8 in FIG. 2.
Figure 7:
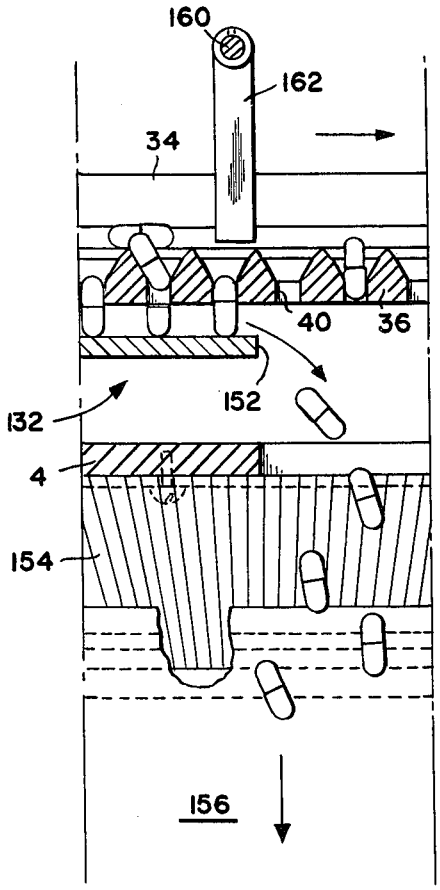
FIG. 7 is a view partially broken away taken on the plane indicated by the line 7—7 in FIG. 2.

Oversized capsules which do not fall into chute 154 are removed from the openings 40 in ring 34 by a manifold 170 connected to a vacuum pump (not shown) and having a downwardly facing opening 172 which is just above the surface of ring 34 (FIG. 8). While normally not necessary, a manifold 176 lying below manifold 170 and ring 34 has upwardly directed openings 178 and is connected to a source of air under pressure to provide an upwardly directed blast of air to assist in dislodging any material retained in openings 40.

From the above description it will be appreciated that complete capsules having a cap diameter which is smaller than the predetermined desired minimum cap diameter will be selected out by sorting wheel 90 due to their falling between adjacent discs 92 and hence dropping down into waste tray 124. Likewise, separate capsule bodies will fall between discs 92 and be discharged into tray 124. Separate caps having a diameter greater than the desired minimum and less than the desired maximum will pass through openings 40 in ring 34 and onto plate 132 from which they will be removed by either manifold 140 or manifold 144. Where the capsule cap of a completed capsule has a diameter greater than the predetermined desired maximum diameter, the capsule will not fall through opening 40 when it passes beyond plate 132 and will be removed by the air passing upwardly out of manifold 176 and the air being pulled out of manifold 170 into which the capsule will be drawn.

It is not desired to be limited except as set forth in the following claims.

We claim:

1. A capsule inspection machine for capsules having a cap and a body comprising:

a horizontal ring having vertical openings having a minimum diameter equal to a predetermined maximum capsule cap diameter for the reception of individual capsules, means to rotate said ring, capsule feeding means, a sorting wheel for receiving capsules from the feeding means having plates perpendicular to the axis of the wheel and spaced apart a distance greater than the diameter of a capsule body and slightly less than the minimum desired diameter of a capsule cap to pass through uncapped bodies and carry capped bodies with caps of the desired minimum diameter, means to rotate the wheel to advance retained capped bodies and discharge them onto said ring, means for directing said capped bodies into said ring openings, a fixed horizontal plate mounted below a portion of the ring to support the capped bodies received in said ring openings, said plate being a distance below said ring greater than the length of a capsule cap and less than the length of a capped body, and said capped bodies being free to move in said ring openings and discharging by gravity from the ring on being moved beyond the plate.

2. A machine in accordance with claim 1 having means to remove caps from the plate below the ring.

3. A machine in accordance with claim 2 in which the means to remove caps employs a vacuum.

4. A machine in accordance with claim 1 in which the openings in the ring have funnel-shaped entrances.

5. A machine in accordance with claim 1 having means to remove the capsules remaining on or in the ring after the said discharging of capped bodies by gravity.

* * * * *